US008011456B2

(12) United States Patent
Sherwood, Jr.

(10) Patent No.: US 8,011,456 B2
(45) Date of Patent: Sep. 6, 2011

(54) ROTATIONALLY INDEXABLE CUTTING ELEMENTS AND DRILL BITS THEREFOR

(75) Inventor: William H. Sherwood, Jr., Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 166 days.

(21) Appl. No.: 11/879,974

(22) Filed: Jul. 18, 2007

(65) Prior Publication Data

US 2009/0020339 A1 Jan. 22, 2009

(51) Int. Cl.
*E21B 10/46* (2006.01)

(52) U.S. Cl. ..... 175/368; 175/412; 175/413

(58) Field of Classification Search ..... 175/368, 175/412, 413, 432, 426
See application file for complete search history.

(56) References Cited

U.S. PATENT DOCUMENTS

| | | | | |
|---|---|---|---|---|
| 4,334,585 | A * | 6/1982 | Upton | 175/432 |
| 4,654,947 | A * | 4/1987 | Davis | 29/402.08 |
| 4,782,903 | A * | 11/1988 | Strange | 175/432 |
| 4,877,096 | A | 10/1989 | Tibbitts | |
| 5,285,859 | A | 2/1994 | Tibbitts | |
| 5,435,403 | A | 7/1995 | Tibbitts | |
| 5,906,245 | A | 5/1999 | Tibbitts et al. | |
| 6,283,234 | B1 * | 9/2001 | Torbet | 175/432 |
| 6,561,293 | B2 | 5/2003 | Minikus et al. | |
| 6,834,733 | B1 | 12/2004 | Maouche et al. | |
| 7,070,011 | B2 | 7/2006 | Sherwood, Jr. et al. | |
| 7,216,565 | B2 | 5/2007 | Sherwood, Jr. et al. | |
| 2004/0173384 | A1 * | 9/2004 | Yong et al. | 175/374 |
| 2006/0278441 | A1 * | 12/2006 | Cooley et al. | 175/374 |
| 2008/0017419 | A1 | 1/2008 | Cooley et al. | |

FOREIGN PATENT DOCUMENTS

EP 0581534 A1 2/1994

OTHER PUBLICATIONS

International Search Report for International Application No. PCT/US2008/070428 mailed Mar. 19, 2010, 4 pages.
PCT Written Opinion for International Application No. PCT/US2008/070428, mailed Mar. 19, 2010.
PCT International Preliminary Report on Patentability for International Application No. PCT/US2008/070428, mailed Mar. 24, 2010.

* cited by examiner

*Primary Examiner* — Jennifer H Gay
*Assistant Examiner* — Brad Harcourt
(74) *Attorney, Agent, or Firm* — TraskBritt

(57) ABSTRACT

A cutting element for use with a drill bit includes a substrate having a longitudinal axis, a lateral surface substantially symmetric about the longitudinal axis and one or more key elements coupled to the lateral surface. The lateral surface lies between an insertion end and a cutting end of the substrate. The one or more key elements are substantially axially aligned with the longitudinal axis and configured to selectively rotationally locate the substrate in a pocket. A drill bit configured for retaining a cutting element having one or more key elements is also disclosed.

21 Claims, 3 Drawing Sheets

ROTATIONALLY INDEXABLE CUTTING ELEMENTS AND DRILL BITS THEREFOR

FIELD OF INVENTION

The invention, in various embodiments, relates to drill bits for subterranean drilling and, more particularly, to rotationally indexable cutting elements as well as drill bits configured for mounting rotationally indexable cutting elements thereon.

BACKGROUND OF INVENTION

Conventional rotary drill bits, such as fixed cutter rotary drill bits for subterranean earth boring, have been employed for decades. It has been found that increasing the rotational speed of such drill bit attached to a drill string has, for a given weight on bit, increased the rate of penetration into the subterranean earth. However, increased rotational speed also has tended to decrease the life of the drill bit due to increased wear and damage of cutting elements mounted on the bit. The cutting elements most commonly employed are referred to as polycrystalline diamond compact (PDC) cutters, which comprise a diamond table formed on a supporting substrate of cemented carbide such as tungsten carbide (WC).

A conventional rotary drill bit comprises a bit body having a shank for connection of the drill bit to a drill string. Typically, the bit body contains an inner passageway for introducing drilling fluid pumped down a drill string to the face of the drill bit. The bit body is typically formed of steel or of a metal matrix including hard, wear-resistant particles, such as tungsten carbide infiltrated with a hardenable liquid copper alloy binder. Brazed into pockets within the bit body are PDC cutters that, together with nozzles for providing drilling fluid to the PDC cutters for cooling and lubrication, remove particles by shearing material from a subterranean formation when drilling. While the drilling fluid extends the life of the PDC cutters, the entrained particulates in the high flow rate drilling fluid comprised of solids in the fluid as well as formation cuttings may erode surfaces of the PDC cutters. Wear of surfaces on the PDC cutters may also be attributable to sliding contact of the PDC cutters with the formation being drilled under weight on bit, as well as by impact stresses caused by a phenomenon known as bit "whirl." When the PDC cutters wear beyond a point where a large wear flat develops and the exposure of the PDC cutter above the surrounding bit face substantially reduces the depth of cut into the adjacent formation, their effectiveness in penetrating and cutting the subterranean formation is diminished, thus requiring repair and/or replacement of the PDC cutters.

In order to appropriately replace and repair the worn or damaged PDC cutters that are brazed into the pockets of the bit body, the drill bit is often (if not always) returned to a repair facility qualified to repair the drill bit, resulting in lost utilization of the drill bit in terms both of time and revenue from drilling. The repair and/or replacement of PDC cutters is further complicated by the manufacturing process of brazing the PDC cutters into the pockets, which requires the controlled application of heat to de-braze and remove any worn and damaged PDC cutters without affecting other cutters on the bit, particularly those not needing repair, followed by brazing in replacement PDC cutters. Accordingly, there is a desire to provide a drill bit that accommodates wear by providing increased utilization of a cutting element in the form of a PDC cutter thereon without resorting to sending the drill bit to a repair facility. It is also desirable to facilitate field replacement of such cutting elements upon the bit body of a drill bit. In this regard, it is desirable to provide rotationally indexable cutting elements, which may be mechanically installed, removed and replaced, as well as drill bits configured for mounting such indexable cutting elements thereon.

BRIEF SUMMARY OF THE INVENTION

In one embodiment, a cutting element for use with a drill bit is provided that provides for in-field replacement upon a drill bit. The cutting element may further enable increased utilization of its diamond table cutting surface without replacement or repair thereof.

The cutting element includes a substrate having a longitudinal axis, a lateral surface substantially symmetric about the longitudinal axis and one or more key elements on the lateral surface. The lateral surface extends between an insertion end of the substrate and a cutting end of the substrate whereon a superabrasive table is disposed, the one or more key elements being generally axially aligned with the longitudinal axis and configured to cooperatively engage another key element in a cutter pocket of a drill bit.

In some embodiments, the key element or elements of a cutting element may comprise visual indicators to facilitate rotational alignment of the cutting element within a cutter pocket of a drill bit.

In additional embodiments, a drill bit configured with cutter pockets having key elements for cooperatively engaging key elements of a cutting element is also disclosed.

Other advantages and features of the invention will become apparent when viewed in light of the detailed description of the various embodiments of the invention when taken in conjunction with the attached drawings and appended claims.

DETAILED DESCRIPTION OF THE INVENTION

Figure 1:
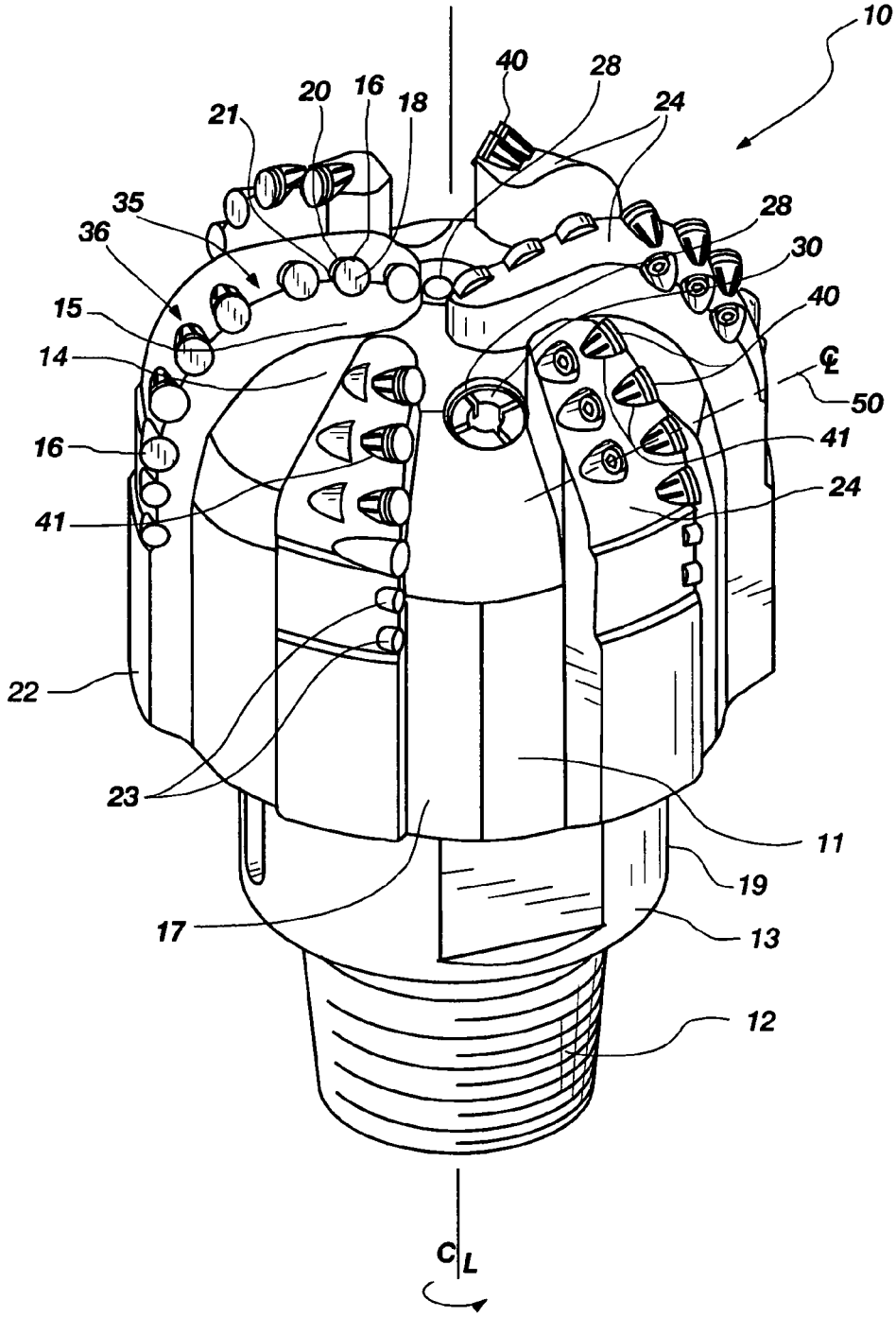
FIG. 1 shows a perspective view of a drill bit in accordance with an embodiment of the invention.

In the description which follows, like elements and features among the various drawing figures are identified for convenience with the same or similar reference numerals.

FIG. 1 shows a perspective view of a drill bit 10 in accordance with an embodiment of the invention. The drill bit 10 is configured as a fixed cutter rotary full bore drill bit, also known in the art as a "drag" bit. The drill bit 10 includes a bit crown or body 11 comprising, for example, tungsten carbide infiltrated with a metal alloy binder, steel, or sintered tungsten or other suitable carbide, nitride or boride as discussed in further detail below, and coupled to a support 19. The support 19 includes a shank 13 and a crossover component (not shown) coupled to the shank 13 in this embodiment of the invention. It is recognized that the support 19 may be made from a unitary material piece or multiple pieces of material in a configuration differing from the shank 13 being coupled to the crossover by weld joints, as described with respect to this particular embodiment. The shank 13 of the drill bit 10 includes conventional male threads 12 configured to American Petroleum Institute (NI) standards and adapted for connection to a component of a drill string, not shown. Blades 24 that radially and longitudinally extend from the face 14 of the bit body 11 each have mounted thereon a plurality of cutting elements, generally designated by reference numeral 16. Each cutting element 16 comprising a polycrystalline diamond compact (PDC) table 18 is formed on a cemented tungsten carbide substrate 20. The cutting elements 16, as secured in respective cutter pockets 21 are positioned to cut a subterranean formation being drilled when the drill bit 10 is rotated under weight on bit (WOB) in a borehole. At least some of the cutting elements 16, and their associated cutter pockets 21, may be configured according to embodiments of the present invention, as hereinafter described. In some embodiments, most if not all of the cutting elements 16 may be configured according to embodiments of the present invention. Others of cutting elements 16 may be conventionally configured and secured, as by brazing, for example, in cutter pockets 21.

The bit body 11 may also carry gage trimmers 23, including the aforementioned PDC tables 18 which may be configured with a flat cutting edge aligned parallel to the rotational axis of the drill bit 10, to trim and hold the gage diameter of a borehole (not shown), and gage pads 22 on the gage which contact the walls of the borehole to maintain the hole diameter and stabilize the drill bit 10 in the hole.

During drilling, drilling fluid is discharged through nozzles 30 located in ports 28 in fluid communication with the face 14 of bit body 11 for cooling the PDC tables 18 of cutting elements 16 and removing formation cuttings from the face 14 of drill bit 10 as the fluid moves into passages 15 and through junk slots 17. The nozzle 30 assemblies may be sized for different fluid flow rates depending upon the desired flushing required at each group of cutting elements 16 to which a particular nozzle 30 assembly directs drilling fluid.

Some of the cutting elements 16 coupled to cutter pockets 21 include cutting elements 40 coupled into cutter pockets 41 in accordance with the embodiment of the invention. The cutting elements 40 are particularly suitable for mounting in the nose region 35 and the shoulder region 36 of blades 24 where observed wear upon and damage to cutting elements 16 is expected to be at its greatest extent. When the cutting elements 40 wear beyond appreciable levels, each cutting element 40 may be mechanically unfastened and rotationally indexed to present an unworn cutting edge of its PDC table 18 and to be again fastened with the unworn cutting edge exposed for subsequent drilling operations. When one or more the cutting elements 40 are worn beyond reusable limits or are significantly damaged, a replacement cutting element 40 may be easily assembled into the cutter pocket 41. Advantageously, the drill bit 10 having the cutter pockets 41 facilitates removal and installation of cutting elements 40 in the field, while minimizing unnecessary and time-consuming repair often associated with replacing cutting elements 16 conventionally affixed to cutter pockets 21 by brazing at a qualified repair facility. While the cutting elements 40 as shown are coupled to cutting pockets 41 primarily in high wear nose and shoulder regions 35 and 36, respectively, in the blades 24 of the bit body 11, the cutting elements 40 may also be coupled to cutter pockets 41 on other locations of blades 24, such as the gage region or cone region, for example and without limitation.

The cutter pockets 41 may be formed or manufactured into blades 24 extending from the face 14 of the bit body 11. The bit crown or body 11 of the drill bit 10 may be formed, for example, from cemented carbide that is coupled to the body blank by welding, for example, after a forming and sintering process and is termed a "cemented" bit. The cemented carbide in this embodiment of the invention comprises tungsten carbide particles in a cobalt-based alloy matrix made by pressing a powdered tungsten carbide material, a powdered cobalt alloy material and admixtures that may comprise a lubricant and adhesive, into what is conventionally known as a green body. A green body is relatively fragile, having enough strength to be handled for subsequent furnacing or sintering, but not strong enough to handle impact or other stresses required to prepare the green body into a finished product in order to make the green body strong enough for particular processes, the green body is then sintered into the brown state, as known in the art of particulate or powder metallurgy, to obtain a brown body suitable for machining, for example. In the brown state, the brown body is not yet fully hardened or densified, but exhibits compressive strength suitable for more rigorous manufacturing processes, such as machining, while exhibiting a relatively soft material state to advantageously obtain features in the body that are not practicably obtained during forming or are more difficult and costly to obtain after the body is fully densified. While in the brown state for example, the cutter pockets 41 may also be formed in the brown body by machining or other forming methods. Thereafter, the brown body is sintered to obtain a fully dense cemented bit.

As an alternative to tungsten carbide, one or more of diamond, boron carbide, boron nitride, aluminum nitride, tungsten boride and carbides or borides of Ti, Mo, Nb, V, Hf, Zr, Ta, Si and Cr may be employed. As an alternative to a cobalt-based alloy matrix material, or one or more of iron-based alloys, nickel-based alloys, cobalt- and nickel-based alloys, aluminum-based alloys, copper-based alloys, magnesium-based alloys, and titanium-based alloys may be employed.

In order to maintain particular sizing of machined features, such as cutter pockets 41, displacements as known to those of ordinary skill in the art may be utilized to maintain nominal dimensional tolerance of the machined features, e.g., maintaining the shape and dimensions of a cutter pocket 41, described below. The displacements help to control the shrinkage, warpage or distortion that may be caused during a final sintering process required to bring the brown body to full density and strength. While the displacements help to prevent unwanted nominal change in associated dimensions of the brown body during final sintering, invariably, critical component features, such as threads, may require reworking prior to their intended use, as the displacement may not adequately prevent against shrinkage, warpage or distortion. While the material of the bit body 11 as described may be made from a tungsten carbide/cobalt alloy matrix, other materials suitable for use in a bit body may also be utilized.

While the cutter pockets 41 are formed in the cemented carbide material of drill bit 10 of this embodiment of the invention, a drill bit may be manufactured in accordance with embodiments of the invention using a matrix bit body or a steel bit body as are well known to those of ordinary skill in the art, for example, without limitation. Drill bits, termed "matrix" bits, and as noted above, are conventionally fabricated using particulate tungsten carbide infiltrated with a molten metal alloy, commonly copper based. The advantages of the invention mentioned herein for "cemented" bits apply similarly to "matrix" bits. Steel body bits, again as noted above, comprise steel bodies generally machined from castings. It is also recognized that steel body bits may also be made from solid materials such as bar stock or forgings, for example and without limitation. While steel body bits are not subjected to the same manufacturing sensitivities as noted above, steel body bits may enjoy the advantages of the invention obtained during manufacture, assembly or retrofitting as described herein, particularly with respect to field indexable, and replaceable, cutting elements 40.

Figure 2:
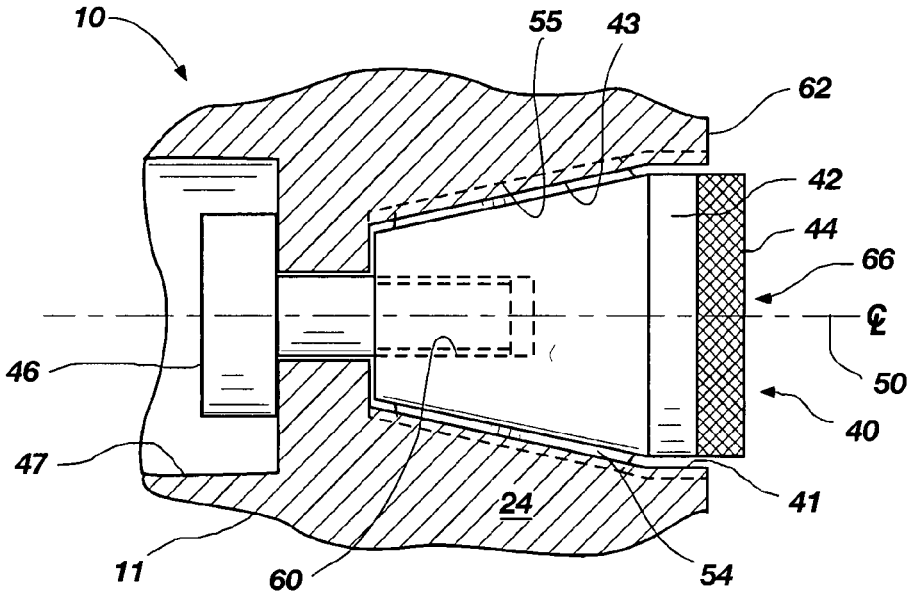
FIG. 2 shows a partial cross-sectional view of a cutting element coupled to a cutter pocket in the drill bit as shown in FIG. 1.
Figure 3A:
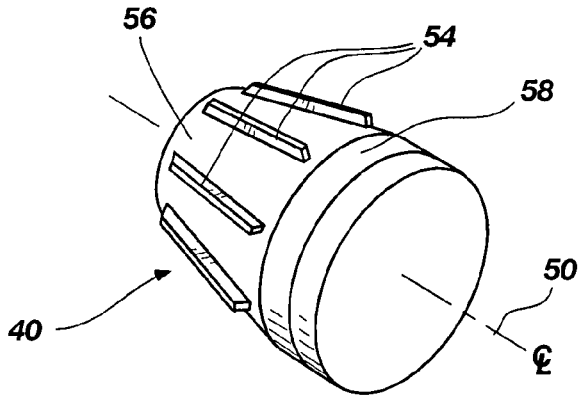
FIG. 3A shows a perspective view of the cutting element as shown in FIG. 2.
Figure 3B:
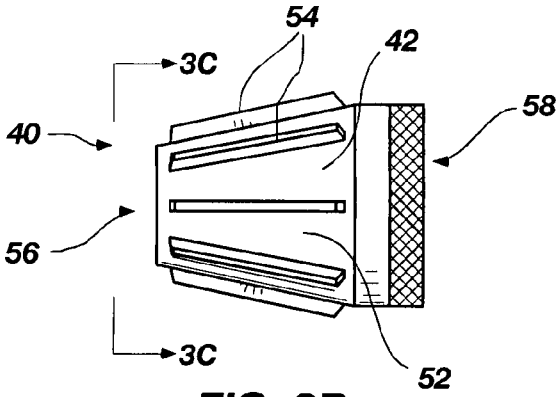
FIG. 3B shows a side view of the cutting element as shown in FIG. 2.
Figure 3C:
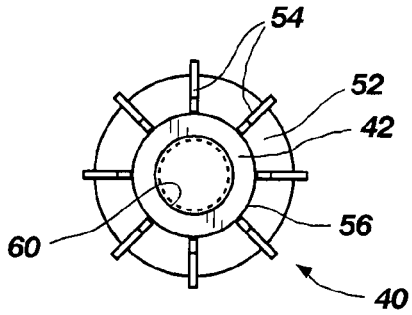
FIG. 3C shows a back view of the cutting element as shown in FIG. 2.

FIG. 2 is a partial cross-sectional view of a portion of drill bit 10 showing a cutting element 40 coupled to a cutter pocket 41. The cutting element 40 is compressively fastened and retained in the cutter pocket 41 by, for example, a fastener such as a hex-head bolt 46 recessed within a cavity 47 on the blade 24. Other types of fasteners such as a socket head cap screw, for example, may also be used to advantage with embodiments of the invention. Simultaneous reference may also be made to FIGS. 3A, 3B and 3C.

The cutting element 40 comprises a substrate 42 having a longitudinal axis 50, a lateral surface 52 and eight key elements 54. The externally facing lateral surface 52 is substantially symmetric about the longitudinal axis 50 and extends between an insertion end 56 and a cutting end 58 of the cutting element 40. As cutting element 40 is depicted, longitudinal axis 50 transversely intersects both the insertion end 56 and the cutting end 58 of the substrate 42. The lateral surface 52 is substantially frustoconical in shape, enabling improved retention of cutting element 40 in the blade 24 of the bit body 11 through compressive engagement with the frustoconically shaped internal surface 43 of the cutter pocket 41. Optionally, the lateral surface 52 may have other surface shapes other than the frustoconically shaped internal surface 43 illustrated.

Each of the eight key elements 54 are coupled to, and protrude from, the lateral surface 52 of the substrate 42 and are generally axially aligned with, and at an acute angle to (due to the frustoconical shape of lateral surface 52) the longitudinal axis 50 thereof, allowing the eight key elements 54 to axially and laterally engage mating pocket key elements 55 configured as grooves within the cutter pocket 41. Also, the eight key elements 54 enable the cutting element 40 to be rotationally located and secured as the insertion end 56 is received within the cutter pocket 41. Further, the eight key elements 54, when engaging mating pocket key elements 55, prevent rotation of the cutting element 40 when firmly secured and retained by the hex-head bolt 46. Each of the eight key elements 54 may comprise a thin outwardly extending strip, such as a spline, each spline extending longitudinally upon a substantial portion of the frustoconically shaped lateral surface 52 and being mutually circumferentially spaced substantially at substantially uniform intervals of 45 degrees from circumferentially adjacent splines.

Optionally, the cutting element 40 may have fewer or greater number of key elements than the eight key elements 54 illustrated, for example, two, three, four or six key elements 54. Also, each of key the eight elements 54 may be spaced at a greater or lesser circumferential increment than the 45 degree increments illustrated. It is also recognized that the mating pocket key elements 55 may have a greater or lesser number of mating pocket key elements 55 than illustrated, and be of the same or greater number than key elements 54. For example, cutting element 40 may carry four key elements 54, while cutter pockets 41 may be formed with eight mating pocket key elements 55. Furthermore, while the mating pocket key elements 55 would be grooves or channels in the internal surface 43 of the cutter pocket 41 for a substrate 42 having externally extending key elements 54, they may be mating pocket key elements 55 extending inwardly from the internal surface 43 of the cutter pocket 41 when a substrate 42 includes recessed key elements, such as grooves or channels, in its lateral surface 52.

The hex-head bolt or fastener 46 engages the fastening structure 60 of substrate 42, comprising a female fastening structure formed as a threaded bore that axially extends into the insertion end 56 of the substrate 42 to retain the cutting element 40 to the blade 24 of the bit body 11. Optionally, the fastening structure 60 may comprise a threaded male stub, or other suitable fastener, that axially extends from the insertion end 56 of the substrate 42 and is axially aligned with the longitudinal axis 50, for example and without limitation, the threaded male stub being engaged by a nut received in cavity 47.

The cutter pocket 41 in this embodiment of the invention is positioned with the cutting element 40 placed toward the rotationally (in the direction of bit rotation) forward facing face 62 of the blade 24.

The cutting element 40 conventionally includes a superabrasive table 44 secured to the cutting end 58 of the substrate 42. As is generally the case with all cutting elements 16, (see FIG. 1) materials of cutting element 40 include the substrate 42 formed from a cemented tungsten carbide material and the superabrasive table 44 formed from polycrystalline diamond material. It is further recognized that a person having ordinary skill in the art may advantageously utilize other materials for the cutting element 40 different from the cemented tungsten carbide and the polycrystalline diamond materials described herein. For example, other carbides may be employed for substrate 42 and cubic boron nitride may be employed for superabrasive table 44. Generally, the superabrasive table 44 is substantially circular in shape and symmetrical about the longitudinal axis 50 allowing a cutting edge 66 of superabrasive table 44 to be rotationally indexed by the rotation of substrate 42 to expose various portions of the cutting edge 66 for engagement with the subterranean formation when in use.

Figure 4A:
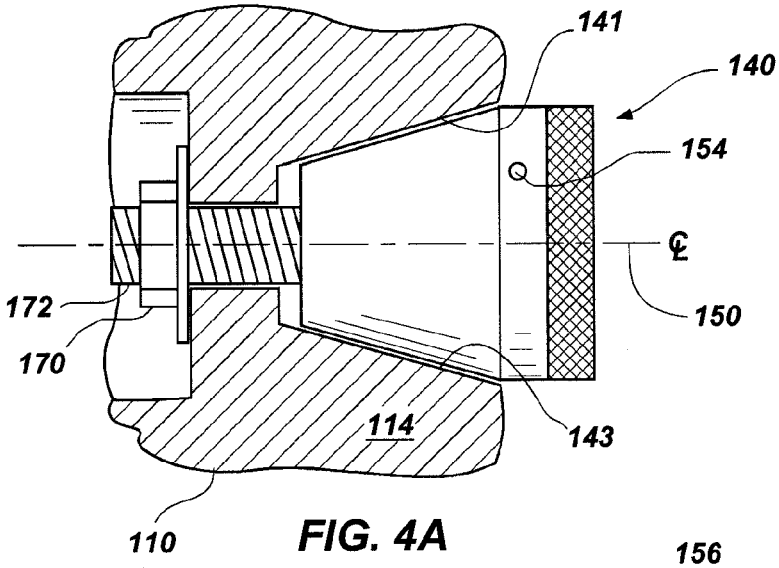
FIG. 4A shows a partial cross-sectional view of a cutting element coupled to a cutter pocket of a drill bit in accordance with another embodiment of the invention.
Figure 4B:
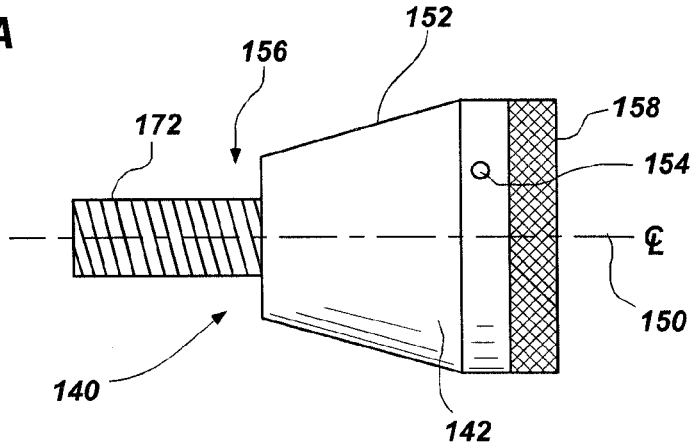
FIG. 4B shows a side view of the cutting element as shown in FIG. 4A.

FIG. 4A shows a partial cross-sectional view of a cutting element 140 coupled to a cutter pocket 141 in a face 114 of a drill bit 110; reference may also be made to FIG. 4B. The cutting element 140 includes a substrate key element 154 for rotationally aligning the cutting element 140 within the cutter pocket 141. Optionally, there may be more than one substrate key element 154 on the cutting element 140. The substrate key element 154 correspondingly engages at least one of the one or more pocket key elements in the form of cavities, grooves or channels (not shown) to facilitate rotationally positioning the cutting element 140 into the cutter pocket 141. The cutting element 140 includes a substrate 142 having a longitudinal axis 150, a lateral surface 152 radially extending substantially about the longitudinal axis 150 and extending between an insertion end 156 and a cutting end 158 of the cutting element 140. While the substrate key element 154 is depicted as a dimple shaped feature protruding from the lateral surface 152 allowing engagement with a pocket key element (not shown) in the cutter pocket 141 to rotationally align the cutting element 140 within the cutter pocket 141, the substrate key element 154 may be a visual marking or other indication to facilitate rotational positioning of the cutting element 140 into the cutter pocket 141, and not a locking element.

The lateral surface 152 of the cutting element 140 comprises a frustoconical external surface sized and configured for compressively mating with the frustoconically shaped internal surface 143 of the cutter pocket 141. The frustoconically shaped surfaces 152 and 143 facilitate non-rotational retention of the cutting element 140 about the longitudinal axis 150 within the cutter pocket 141 when fastened and secured to the drill bit 110 by a nut 170. While the cutting element 140 includes a threaded stub 172 extending from the insertion end 156 of the substrate 142, other suitable mechanical fasteners may be utilized. Advantageously, the frustoconically shaped surfaces 152 and 143 facilitate removal of the cutting element 140 from the drill bit 110 after drilling use, allowing the cutting element 140 to be rotationally indexed or otherwise rotated into a different orientation within the cutter pocket 141 to extend its life without complicated repair or re-fabrication of the drill bit 110. While the cutting element 140 includes a frustoconically shaped lateral surface 152, other surfaces may be utilized to advantage such as a cylindrical surface or a rectilinear shaped surface, for example.

Figure 5A:
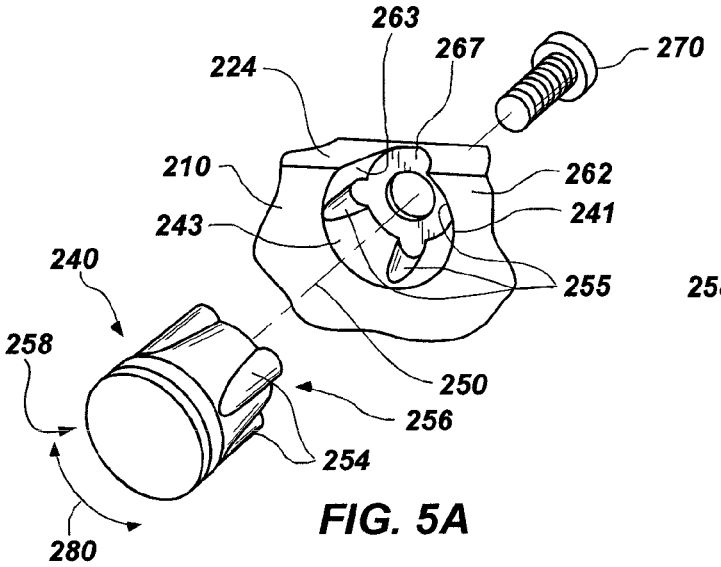
FIG. 5A shows an exploded assembly view of a cutting element being rotationally fixed and configured to be mechanically coupled to a cutter pocket of a drill bit in accordance with yet another embodiment of the invention.
Figure 5B:
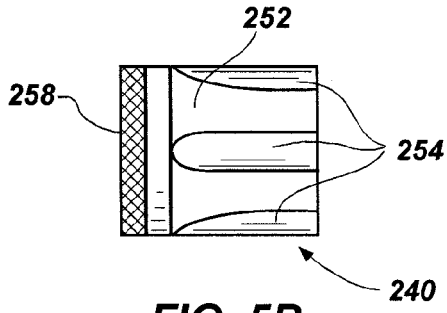
FIG. 5B shows a side view of the cutting element as shown in FIG. 5A.

FIG. 5A shows an exploded assembly view of a cutting element 240 being rotationally aligned with and coupled to a cutter pocket 241 in a blade 224 of a drill bit 210. Reference may also be made to FIG. 5B.

The cutter pocket 241 includes an internal surface 243 that is generally cylindrically tapered inwardly about a longitudinal axis 250 and includes three semi-cylindrical shaped (in transverse cross section) pocket structures or key elements 255 extending into the internal surface 243. The three semi-cylindrical shaped pocket key elements 255 each include a centerline (not shown) that is substantially parallel with the longitudinal axis 250. The three semi-cylindrical shaped pocket key elements 255 are each symmetrically circumferentially positioned about the internal surface 243 of the cutter pocket 241 for receiving a cutting element 240 having at least one semi-cylindrically shaped key element 254 protruding therefrom. The internal surface 243 of the cutter pocket 241 extends from the leading face 262 of the blade 224 into a rotationally trailing portion 263 of the blade 224. The cutter pocket 241 may also include a retention wall 267 to provide anchoring support for fastening the cutting element 240 to the blade 224.

The cutting element 240 includes an external surface 252 that is generally cylindrical and tapered inwardly about the longitudinal axis 250 from a cutting end 258 toward an insertion end 256, and includes four semi-cylindrical shaped structures or key elements 254 extending from the part frustoconically shaped external surface 252 thereof. The semi-cylindrical shaped key elements 254 each include a centerline (not shown) that is substantially parallel with the longitudinal axis 250 of the cutting element 240. The semi-cylindrical shaped key elements 254 are circumferentially positioned about the external surface 252 of the cutting element 240 uniformly, such as at 90 degree intervals, allowing the cutting element 240 to be inserted by way of the insertion end 256 into the cutter pocket 241 as illustrated. While the semi-cylindrical shaped key elements 254 are circumferentially positioned about the external surface 252 of the cutting element 240 uniformly at 90 degree intervals, the semi-cylindrical shaped key elements 254 may be other than four in number and circumferentially positioned about the external surface 252 of the cutting element 240 at other uniform or non-uniform intervals. The cutting element 240 is then retained by the blade 224 of the drill bit 210 by a bolt or fastener 270, as previously described with respect to other embodiments.

When the subterranean formation-engaging portion of the cutting element 240 is worn beyond an appreciable amount, the cutting element 240 may be further utilized by releasing the fastener 270 and rotationally indexing the cutting element 240 as indicated by arrow 280 in either direction to expose another, unworn portion of the cutting element 240 that is suitable for engaging the subterranean formation.

While the pocket structures or key elements 255 of the cutter pocket 241 and the key elements 254 of the cutting element 240 are semi-cylindrical shaped, other shaped indices may be utilized in accordance with the invention.

In other embodiments, the cutting elements 40, 140 and 240 may include a greater or lesser number of key elements than illustrated, while the cutter pockets may include a greater or lesser number of pocket structures or key elements than illustrated. Generally, the key elements and/or pocket structures or key elements will allow the cutting element to be strategically placed and manipulated within a cutter pocket in order to obtain increased usage of a drill bit through extended life of the cutting elements without having to subject the drill bit to complicated and time consuming repair conventionally required when refurbishing a drill bit. Further, when repair is required due to cutting element damage or extreme wear, cutting elements according to embodiments of the invention may be quickly and easily replaced in the field, on the drilling rig floor if required.

While particular embodiments of the invention have been shown and described, numerous variations of the illustrated embodiments as well as other embodiments will readily occur to those of ordinary skill in the art. Accordingly, the scope of the invention is limited only in terms of the language of appended claims and their legal equivalents.

What is claimed is:

1. A cutting element for subterranean drilling, comprising:

a substrate having a longitudinal axis and a lateral surface substantially symmetric about the longitudinal axis, the lateral surface of the substrate comprising a substantially continuous surface extending between an insertion end and a cutting end of the substrate;

a superabrasive table disposed on the cutting end of the substrate, the superabrasive table having a face oriented substantially transverse to the longitudinal axis; and a plurality of key elements spaced at substantially equal circumferential intervals about the lateral surface and substantially axially aligned with the longitudinal axis, wherein at least one key element of the plurality of key elements comprises an element protruding from the lateral surface, and wherein each of the plurality of key elements is complementary to each key element of a plurality of key elements of a cutter pocket formed in a rotary drill bit on which the cutting element is to be installed.

2. The cutting element of claim 1, wherein at least a portion of the lateral surface is substantially frustoconical.

3. The cutting element of claim 1, further comprising a fastening structure associated with the insertion end of the substrate.

4. The cutting element of claim 3, wherein the fastening structure comprises a threaded female structure extending axially into the insertion end of the substrate.

5. The cutting element of claim 3, wherein the fastening structure comprises a threaded male stub extending axially from the insertion end of the substrate and aligned with the longitudinal axis.

6. The cutting element of claim 1, wherein the superabrasive table is substantially circular and formed of a polycrystalline diamond compact material or a cubic boron nitride material.

7. The cutting element of claim 1, wherein each of the plurality of key elements comprises an element protruding from the lateral surface.

8. The cutting element of claim 7, wherein the protruding element comprises a spline.

9. The cutting element of claim 1, wherein at least one of the plurality of key elements comprises a structure semi-cylindrical in cross-section.

10. The cutting element of claim 9, wherein the structure semi-cylindrical in cross-section extends substantially parallel to the longitudinal axis and the lateral surface is substantially frustoconical.

11. The cutting element of claim 1, wherein at least one key element of the plurality of key elements comprises a channel recessed in the lateral surface.

12. A rotary drill bit for subterranean drilling, comprising:

a bit body with at least one cutter pocket having a plurality of pocket key elements on an interior lateral surface thereof; and a cutting element comprising:

a substrate having a longitudinal axis and a lateral surface substantially symmetric about the longitudinal axis, the lateral surface of the substrate comprising a substantially continuous surface extending between an insertion end and a cutting end of the substrate;

a superabrasive table disposed on the cutting end of the substrate, the superabrasive table having a face oriented substantially transverse to the longitudinal axis;

a plurality of substrate key elements spaced at substantially equal circumferential intervals about the lateral surface and substantially axially aligned with the longitudinal axis, wherein at least one substrate key element of the plurality of substrate key elements comprises an element protruding from the lateral surface, and wherein each of the plurality of substrate key elements is complementary to each pocket key element of the plurality of pocket key elements of the at least one cutter pocket of the bit body; and a fastening structure positioned at the insertion end of the cutting element.

13. The rotary drill bit of claim 12, wherein each of the plurality of pocket key elements comprises a groove and the at least one substrate key element of the plurality of substrate key elements comprises a spline.

14. The rotary drill bit of claim 12, wherein the lateral surface of the substrate includes at least a frustoconical portion, and the at least one cutter pocket includes a substantially mating frustoconical internal surface.

15. The rotary drill bit of claim 12, wherein the fastening structure of the cutting element comprises a threaded hole extending axially into the insertion end of the substrate, and the cutting element further comprising a threaded bolt engaging the threaded hole and compressively coupling the cutting element in the at least one cutter pocket.

16. The rotary drill bit of claim 12, wherein the superabrasive table comprises a polycrystalline diamond compact material or a cubic boron nitride material.

17. The rotary drill bit of claim 12, wherein the at least one substrate key element of the at least three key elements extends from substantially the insertion end to substantially the cutting end of the cutting element.

18. A cutting element comprising:

a substrate having a longitudinal axis, a lateral frustoconical surface substantially symmetric about the longitudinal axis and extending between an insertion end and an opposing, cutting end of the substrate;

a fastening structure positioned on and extending from the insertion end;

a superabrasive table coupled to the cutting end, the superabrasive table having a face oriented substantially transverse to the longitudinal axis; and at least three key elements spaced at substantially equal circumferential intervals about the lateral frustoconical surface and substantially axially aligned with the longitudinal axis, wherein at least one key element of the at least three key elements comprises a spline protruding from the lateral frustoconical surface of the substrate, wherein the at least one key element of the at least three key elements comprises a longitudinal axis that is substantially parallel to the longitudinal axis of the substrate, and wherein each of the at least three key elements is complementary to each key element of a plurality of key elements of a cutter pocket formed in a rotary drill bit on which the cutting element is to be installed.

19. The cutting element of claim 18, wherein the superabrasive table is substantially circular and comprises one of a polycrystalline diamond compact material and a cubic boron nitride material.

20. The cutting element of claim 18, wherein each of the at least three key elements comprises a spline protruding from the lateral surface.

21. The cutting element of claim 18, wherein the lateral frustoconical surface of the substrate comprises a substantially continuous surface.

* * * * *